US006219887B1

(12) United States Patent
Parsons

(10) Patent No.: US 6,219,887 B1
(45) Date of Patent: Apr. 24, 2001

(54) FOLDING STRAP DISPOSABLE RESTRAINTS

(75) Inventor: Kevin L. Parsons, Appleton, WI (US)

(73) Assignee: Armament Systems and Procedures, Inc., Appleton, WI (US)

( * ) Notice: Subject to any disclaimer, the term of this patent is extended or adjusted under 35 U.S.C. 154(b) by 0 days.

(21) Appl. No.: 09/477,232

(22) Filed: Jan. 4, 2000

Related U.S. Application Data

(63) Continuation-in-part of application No. 09/149,625, filed on Sep. 8, 1998, now Pat. No. 6,101,682, which is a continuation-in-part of application No. 08/755,231, filed on Nov. 22, 1996, now Pat. No. 5,802,675, which is a continuation of application No. 08/520,979, filed on Aug. 28, 1995, now Pat. No. 5,669,110.

(51) Int. Cl.[7] ..... E05B 75/00; B65D 63/00

(52) U.S. Cl. ..... 24/16 PB; 24/484; 70/16

(58) Field of Search ..... 24/16 PB, 16 R, 24/17 AP, 30.5 P, 30.5 R, 484; 70/16, 18; 128/869, 879

(56) References Cited

U.S. PATENT DOCUMENTS

| | | | | |
|---|---|---|---|---|
| 4,854,138 | | 8/1989 | Charland . | |
| 4,910,831 | | 3/1990 | Bingold . | |
| 4,964,419 | | 10/1990 | Karriker . | |
| 5,377,510 | * | 1/1995 | Smith | 24/16 PB X |
| 5,669,110 | | 9/1997 | Parsons . | |
| 5,794,461 | * | 8/1998 | Smith | 70/16 |
| 5,802,675 | | 9/1998 | Parsons . | |
| 5,802,888 | | 9/1998 | Parsons . | |

* cited by examiner

*Primary Examiner*—Robert J. Sandy
(74) *Attorney, Agent, or Firm*—McDonnell Boehnen Hulbert & Berghoff

(57) ABSTRACT

A training restraint having double loops formed of two separate, flexible straps joined together by an interlocking cover is extremely strong, tamper resistant and more easily molded than single strap devices. The restraint is designed to be folded into a compact storage position which can be easily carried by law enforcement personnel yet is instantly ready for use. The restraint is designed for repeated use and is provided with indicia to identify the device for training purposes.

10 Claims, 5 Drawing Sheets

FOLDING STRAP DISPOSABLE RESTRAINTS

FOLDING STRAP DISPOSABLE RESTRAINTS

This is a continuation-in-part application of U.S. patent application Ser. No. 09/149,625, filed Sep. 8, 1998, now U.S. Pat. No. 6,101,682, which is a continuation-in-part of 08/755,231, filed on Nov. 22, 1996, now U.S. Pat. No. 5,802,675, which is a continuation of U.S. patent application Ser. No. 08/520,979, filed on Aug. 28, 1995, now U.S. Pat. No. 5,669,110.

BACKGROUND OF INVENTION

1. Field of Invention

The subject invention is generally related to restraining devices for use by law enforcement personnel and is specifically directed to an improved disposable restraining device having flexible straps forming two secure loops.

2. Description of the Prior Art

Restraining devices such as handcuffs are well-known and have been available for many years. The best known restraining devices are handcuffs consisting of a pair of metal rings which are placed about the wrists of an individual and locked into place. While traditional handcuffs serve the purpose of restraining an individual, they have a number of drawbacks. Conventional handcuffs are heavy, bulky to carry, expensive, require a key and are often inconvenient, particularly in multiple arrest situations such as riots and the like. Because of these drawbacks, it has become more and more desirable to design handcuffs which are lightweight, inexpensive and do not require a key. Moreover, it has become desirable to utilize disposable handcuffs, particularly in multiple arrest situations.

Further, there has been a movement toward using disposable handcuffs due to the increasing concern of the spreading of AIDS, as well as Hepatitis, since restrained individuals who struggle violently often create open wounds which result in blood on the handcuffs. Disposable handcuffs assure that the handcuffs will not be reused and thereby create a carrier for communicable diseases through contamination due to cuts or abrasions received during the detainment.

Disposable handcuffs are available which address some of the problems of conventional key-operated handcuffs. U.S. Pat. No. 4,964,419 entitled "Keyless Handcuffs", issued to R. L. Kariker on Oct. 23, 1990; U.S. Pat. No. 4,854,138 entitled "Restraining Device", issued to Robert S. Charland on Aug. 8, 1989; and U.S. Pat. No. 4,910,831 entitled "Two-Loop Law Enforcement Restraining Device Formed From A Single, Flat Strap" issued to Richard F. Bingold on Mar. 27, 1990 illustrate some types of disposable handcuffs.

While such prior art double-loop disposable handcuffs meet the functional requirements of a restraining device, a major disadvantage is that a detainee can release himself by tampering with the device. For example, the prior art plastic disposable handcuffs may be friction cut by vigorously rubbing a piece of string or twine, such as a shoelace against the strap until sufficient heat is generated to cut through the plastic. Alternatively, the detainee may release himself by using a small piece of wire or a pin or nail to wedge underneath the locking area of the handcuff to shim open the locking wedge which secures the loops in place, thereby allowing the strap to be withdrawn and releasing the handcuffs.

The subject invention is specifically directed to an improvement of the type of disposable handcuffs generally described in my U.S. patent application Ser. No. 08/327,042, now abandoned, entitled "Flexible Strap Restraining Device" which is an improvement over the prior art devices. Specifically, the device of U.S. patent application Ser. No. 08/327,042 includes a flexible strap having a core material, such as a metal wire, which is designed to prevent the detainee from cutting or melting through the strap by vigorously rubbing it against a piece of string. The invention also includes a unique locking mechanism designed to prevent the detainee from using a pin or wire to shim open the lock to release himself. In order to increase the stowability of the device and provide law enforcement personnel with a convenient means for carrying it, this invention also includes an integral hinge located in the center of the strap. In addition, the invention may include a sliding cover which slides onto the strap and over the hinge area and locking mechanisms.

While the device of U.S. patent application Ser. No. 08/327,042 addresses many of the problems of the prior art devices, one drawback is that the integral hinge located in the center portion of the strap may result in a weakened area between the two loops where stress is the greatest. Moreover, due to the single strap design with the locking mechanisms and hinge located on the strap, the wire core material cannot extend through the entire strap and is not included in the center portion of the strap where the hinge is located. Thus, the center portion is more susceptible to being friction cut or broken by the detainee.

While the locking mechanism of the single strap device is designed to include additional locking features, another disadvantage is that the locking mechanisms are exposed and may be pried open to release the strap. Although the addition of the sliding cover to the strap may provide some protection, the sliding cover is not an integral part of the device and the detainee may be able to forcibly move the cover from its intended position to expose and tamper with the locking mechanism. Also, since the sliding cover is not an integral part of the device, the cover may become detached and lost. Further, the addition of the sliding cover to the strap may be cumbersome because of the location of the cover on the strap when the device is not in use. In addition, because the sliding cover is not required to operate the single strap device, the device may be applied without the sliding cover and any additional protection would be lost.

Another disadvantage of the single flexible strap device is that the hinge located in the center of the strap has a tendency to spring "flat" and the device may not stay folded for storage. In addition, the single strap device must be unfolded and then assembled into the loops before it is ready for use. Further, the long narrow part of the single strap device is more difficult to mold and costly to produce. Also, the addition of the sliding cover to the single strap device would require the manufacture of an additional part which may further increase the production costs.

Therefore, there is a need for an improved, disposable double-loop restraining device which is extremely strong, tamper resistant, easily carried and ready for instant application and is less costly to produce.

SUMMARY OF THE INVENTION

The subject invention is directed to an improved disposable restraining device having double loops formed of two separate flexible straps joined together by an interlocking cover. The improved disposable restraining device is specifically designed to be extremely strong and tamper resistant. The invention is designed to be folded into a compact storage position and to allow an officer to quickly and easily place the device into service from its storage position. In addition, because it utilizes two separate straps, the improved disposable restraining device is more easily molded than the long single strap of prior art devices and is less costly to manufacture. In fact, existing single loop ties, such as wire ties and the like, can be used for the improved restraining device of the preferred embodiment.

In the preferred embodiment, each flexible strap includes a free tip end and a locking box with a central opening at the other end. The free tip end of each strap is adapted to be threaded through the central opening of the locking box to form a loop. The locking box includes a detent or spring which projects into the central opening and resiliently engages the strap to retain the strap in the looped form once it has been inserted into the opening. The interlocking cover of the subject invention is designed to receive the locking box ends of the straps and join the looped straps together. The interlocking cover includes a top and bottom wall, open opposite ends and a hollow interior. The top and bottom walls include a pair of slots which are positioned to be in alignment with the central opening of the locking boxes once they are inserted into the cover. Because the interlocking cover protects the locking area of the straps and no unique locking mechanism is necessary, existing single loop ties can be used to construct the device.

Each flexible strap includes a saw-tooth ribbed surface which prevents the strap from being withdrawn once it is inserted into the opening and engaged by the detent. When assembled, the locking boxes are inserted in the open ends of the cover and the free tip end of each strap is threaded through the slots in the cover and through its respective locking box, thereby forming the straps into two loops and locking the two looped straps into the cover to form the restraining device.

In the preferred embodiment, each strap also includes a locking tooth positioned near the free tip end and spaced-apart from the saw-tooth ribbed surface. The locking tooth is positioned so that the free tip end of the strap does not extend beyond the wall of the cover when the locking tooth and detent are engaged. Thus, in the storage position, the free tip ends of the assembled device do not extend beyond the wall of the cover.

Further, the locking tooth is positioned a sufficient distance from the saw-tooth ribbed surface for creating a free zone between the locking tooth and the saw-tooth ribbed surface. The surface of the strap in the free zone is smooth to permit sliding movement of the strap in either direction for extending the free tip end beyond the wall of the cover and retracting it to its storage position. In use, the officer pushes the looped strap toward the cover to slide the free tip end through the slot and beyond the wall of the cover for grasping the free tip end. At this point, the officer may either grasp the free tip end and apply the restraint to the detainee by pulling the strap so that the detent engages the saw-tooth ribbed surface or the tip end may be slidably returned to its storage position within the cover.

While the straps are made of a flexible material, the cover of the preferred embodiment is constructed from a harder, less flexible material, such as a polycarbonate or even metal, to provide maximum strength at the center of the restraints where stress is the greatest. In addition, the interlocking cover of the subject invention completely surrounds and protects the locking boxes against tampering so that they cannot be pried open. In the preferred embodiment, each strap will include a tamper resistant core material extending through the length of the strap and partially into the locking box for strengthening the strap and providing a restraining device which cannot be friction cut.

It is an important feature of the subject invention that the interlocking cover may be reused after the straps have been cut in order to remove the device from a detainee. Once the straps are cut, they may be easily removed from the cover and replaced with two new separate, flexible straps. The device may be easily reassembled using the same interlocking cover by inserting the locking box ends of two new straps into the open ends of the cover and pulling the free tip end of each strap through the slots in the cover. Because the interlocking cover is the most expensive piece of the device, the improved disposable restraining device is less costly to produce while still providing an extremely strong, tamper resistant, disposable restraining device.

In the preferred embodiment, each looped strap of the restraining device includes at least one bend line or notch for folding the strap at its center to form a trifold for providing an extremely compact restraint which is easily carried and instantly ready for use by pulling out the center of each loop. Thus, the improved double loop restraining device of the subject invention can be quickly and easily applied from its storage position without requiring the officer to assemble the straps into loops after they have been moved into place.

It is also desirable to provide a training embodiment of the subject invention that is capable of being used repeatedly. In the non-training embodiment, once the straps are tightened, the detents prevent the straps from being loosened. To remove the restraints, the straps must be severed. Thus, for training purposes, it is desirable to provide a restraint where the straps may be repeatedly tightened and loosened. In addition, in order to provide training restraints, sometimes the detents in the locking boxes are filed down and removed. From looking at the exterior of these devices, law enforcement personnel can not tell whether the detents have been removed and, as a result, can not distinguish the training devices from the actual devices. Thus, it would be useful to provide such a restraint with means to identify it as a training embodiment. With such identifying means, law enforcement personnel can use these restraining devices in their actual training exercises without any confusion.

Therefore, it is an object and feature of the subject invention to provide an extremely strong, tamper resistant, disposable double loop restraining device including two separate, flexible straps joined together by an interlocking cover.

It is another object and feature of the subject invention to provide an improved disposable restraining device including an interlocking cover constructed of a harder, less flexible material than the straps to provide maximum strength at the center of the restraining device.

It is a further object and feature of the subject invention to provide an improved disposable restraining device including an interlocking cover which completely surrounds and protects the locking mechanism for each strap against tampering.

It is yet another object and feature of the subject invention to provide a foldable disposable double loop restraining device which is easily carried and instantly ready for use by pulling out the center of each loop.

It is still another object and feature to provide a training embodiment of the subject invention.

Other objects and of the subject invention features will be readily apparent from the accompanying drawings and description.

DETAILED DESCRIPTION OF THE DRAWINGS

Figure 1:
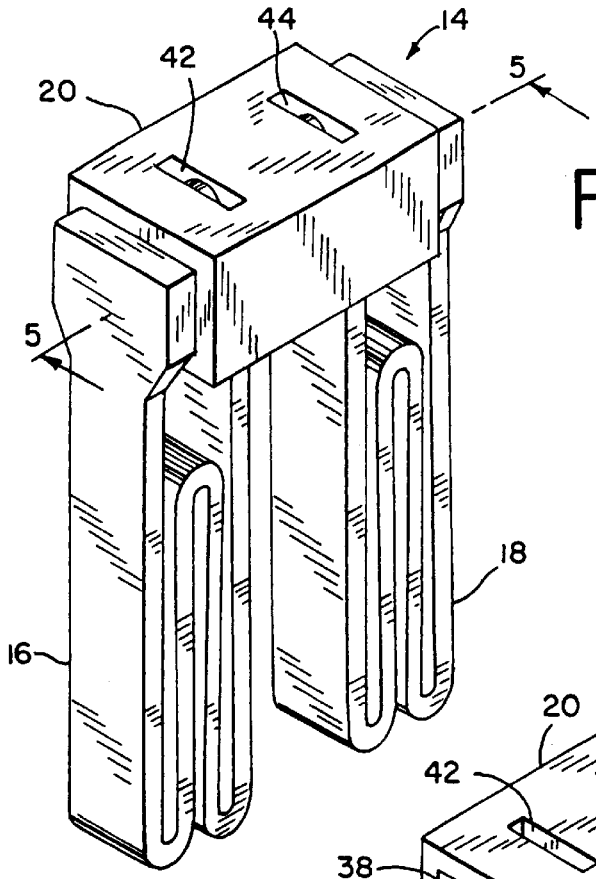
FIG. 1 is perspective view of the preferred embodiment of the improved disposable restraining device including two separate flexible straps joined together by an interlocking cover and shown in the folded, storage position.

Referring to FIGS. 1–4, the improved disposable restraining device of the subject invention is generally designated by the numeral 14. The improved disposable restraining device 14 includes a first flexible strap 16 and a second, separate flexible strap 18 formed into two loops and joined together by an interlocking cover 20. As shown in FIG. 1, the straps 16 and 18 are designed to be folded into a compact storage position. Thus, the subject invention provides an extremely compact disposable restraining device 14 which can be easily carried yet is instantly ready for use by pulling out the center of the looped strap (see FIG. 3).

Figure 2:
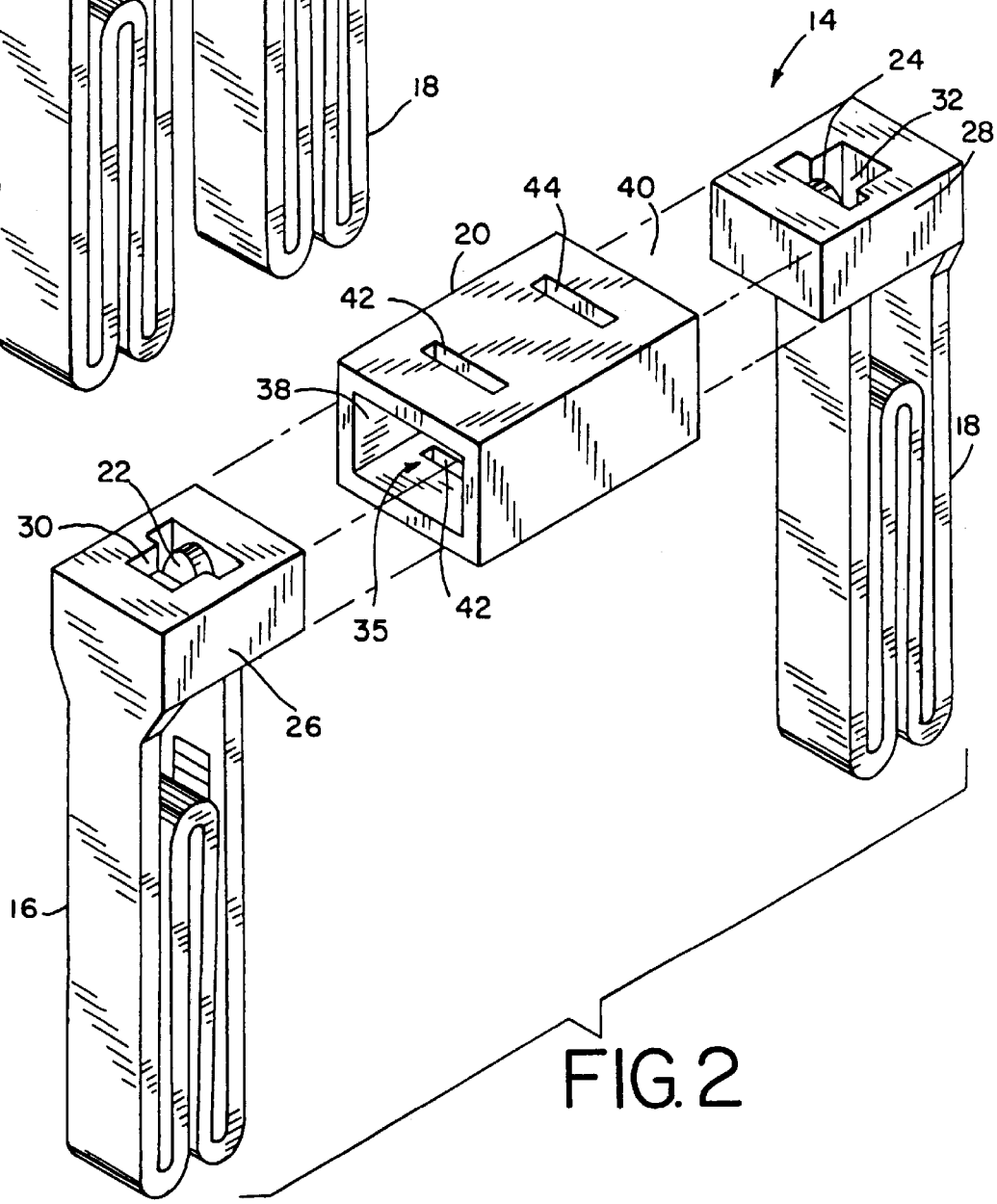
FIG. 2 is a perspective view of the improved disposable restraining device including an exploded view of the locking box ends of the straps removed from the interlocking cover and illustrating the placement of the locking boxes in the cover and slots in the top and bottom walls of the cover for receiving the free tip ends of the straps.
Figure 4:
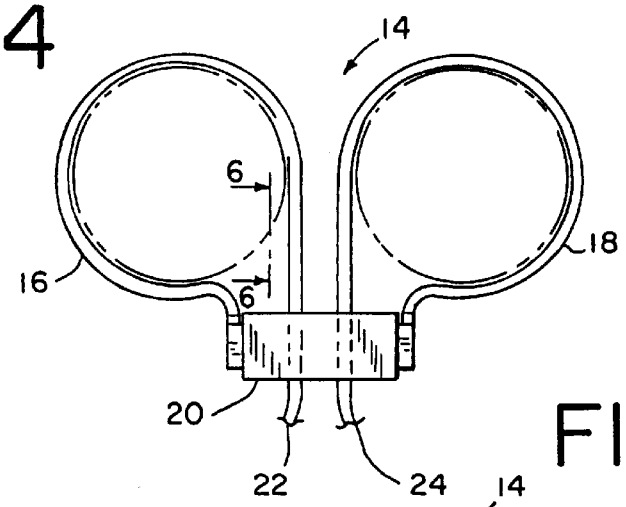
FIG. 4 is a side view of the improved disposable restraining device assembled and ready for use.
Figure 6:
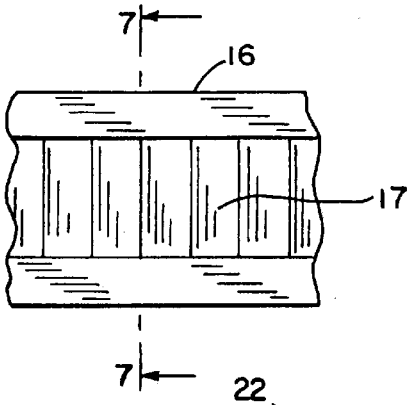
FIG. 6 is a fragmentary plan view taken along line 6—6 of FIG. 4 of the saw tooth ribbed surface ofthe straps.
Figure 7:
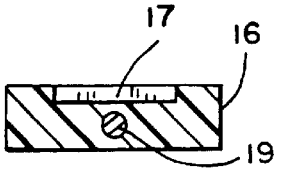
FIG. 7 is an enlarged cross-sectional view illustrating the core material embedded in the strap.

Each flexible strap 16 and 18 of the subject invention comprises an elongated, substantially flat straight strap having two outer ends. As shown in FIG. 2, the outer ends of each strap 16 and 18, include a free tip end 22 and 24, at one end, and a locking box 26 and 28, at the other end. Each strap 16 and 18 is preferably made of an inexpensive, lightweight, strong, stiffly flexible, plastic material, similar to wire ties and bag ties, and the surface of each strap consists of a plurality of saw tooth ribs 17 (see FIGS. 5 and 6). In the preferred embodiment, the strap contains a core material imbedded in the body of each strap 16 and 18 and extending the length of the strap, partially into the locking boxes 26 and 28 (see FIGS. 5 and 7). The core material may be a metal wire 19 or an abrasion resistant, non-metallic fiber.

In the preferred embodiment, each locking box 26 and 28 is molded to extend perpendicularly from its respective strap 16 and 18, thus forming an "L" shaped strap so that in the assembled device, the straps 16 and 18 extend vertically from the cover 20 (see FIGS. 1–5). Each locking box 26 and 28 has a central opening 30 and 32, respectively, which extends through each box 26 and 28 and is adapted to receive the free tip end 22 and 24 of each strap 16 and 18.

Figure 5:
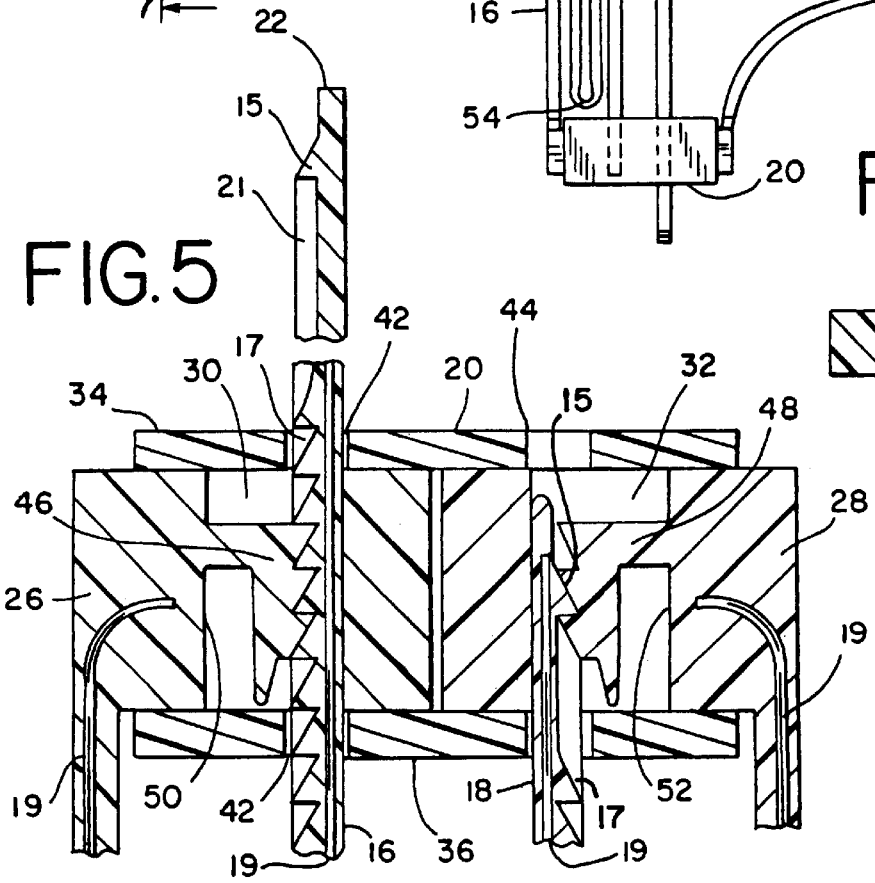
FIG. 5 is an enlarged cross-sectional view taken along line 5—5 of FIG. 1 showing the ends of the straps inserted into the locking boxes and a locking tooth near the tip end and spaced apart from the saw tooth ribbed surface where the strap has been pulled through the locking box so that the saw tooth ribbed surface of the straps is engaged by the locking detent for holding the strap in place, and illustrating the core material of each strap extending into the locking box.

As shown in FIG. 5, the interior of each locking box 26 and 28 is hollow and includes a detent 46 and 48 secured to an outer wall 50 and 52, respectively, which projects into the central openings 30 and 32. The detents 46 and 48 are adapted to resiliently engage the saw tooth ribbed surface 17 of each strap 16 and 18, to retain the strap once it has been inserted into each central opening 30 and 32 to prevent the strap from being withdrawn.

As best seen in FIG. 2, the interlocking cover 20 includes a top wall 34, a bottom wall 36, opposite open ends 38 and 40 and a hollow interior 35. The top and bottom walls 34 and 36 include slots 42, for receiving the free tip end 22 of strap 16, and slots 44, for receiving the free tip end 24 of strap 18. The opposite open ends 38 and 40 of the cover 20 are adapted to receive the locking boxes 26 and 28. When assembled, the locking boxes 26 and 28 are inserted into the open ends 38 and 40 and the slots 42 and 44 are positioned to be in alignment with central openings 30 and 32, respectively.

Once it is positioned in the cover, the locking box 26 is locked in the hollow interior 35 of the cover 20 by threading the free tip end 16 through the slot 42 of the bottom wall 36, through the central opening 30 and through the slot 42 of the top wall 34 to form a first loop. Likewise, the locking box 28 is locked in place by threading the free tip end 18 through the slot 44 of the bottom wall 36, through the central opening 32 of the locking box 28 and through the slot 44 of the top wall 34 to form a second loop joined to the first loop by the cover 20. Thus, by inserting the locking boxes 26 and 28 into the cover 20 and threading the free tip ends 22 and 24 therethrough, the straps 16 and 18 are formed into two loops and the two looped straps are locked into the cover 20 to form the restraining device 14.

In the preferred embodiment, each strap 16 and 18 also includes a locking tooth 15 positioned near the free tip end 22 and 24 (see FIG. 5). The locking tooth 15 is engaged by the detents 46 and 48 to retain the strap in two loops and is positioned so that the free tip end 22 and 24 do not extend beyond the wall of the cover in the assembled storage position (see FIG. 1). As shown in FIG. 5, the locking tooth 15 is spaced apart from and positioned a sufficient distance from the saw tooth ribbed surface 17 for creating a recessed free zone 21 between the locking tooth 15 and the saw tooth ribbed surface. The surface of the free zone 21 is smooth to permit sliding movement of the strap in either direction for extending the free tip end beyond the wall of the cover and retracting it to its storage position. In addition, smooth surface 21 also provides a writing surface for making notations directly on restraining device 14. As is seen in FIG. 5, smooth surface 21 may be recessed. The recessed nature of the smooth surface 21 is a significant feature of the invention because it protects the notations made thereon from smudging or accidental erasure. This is important especially in conditions where the restraining device is objected to a wet or dirty environment or where a suspect could intentionally or unintentionally rub or wipe surface 21 of device 14. In the preferred embodiment, the length of the free zone 21 is two inches.

In use, an officer grips the strap and slides it toward the cover so that the free tip end is extended through the slots 42 and 44 beyond the wall of the cover for allowing the officer to grip the tip ends 22 and 24. Because the free zone 21 permits sliding movement of the strap between the locking tooth 15 and the saw tooth ribbed surface 17, the extended tip ends 22 and 24 may be retracted to their storage position. Alternatively, the extended tip ends may be grasped and pulled so that the saw tooth ribbed surface is engaged by the detents 46 and 48 for tightening or cinching the loops to restrain the detainee.

While the straps 16 and 18 are made of a flexible material, it is an important feature of the invention that the cover 20 may be constructed of a harder, less flexible material to provide maximum strength at the center of the device 14 where stress is the greatest. In the preferred embodiment, the interlocking cover 20 is constructed of a polycarbonate and the core material 19 is a metal wire. This feature, in combination with the tamper resistant core material 19 extending through the length of each strap 16 and 18, provides an extremely strong, tamper resistant, improved disposable restraining device. Further, the two separate straps 16 and 18 of the subject invention are more easily molded and less costly to manufacture that the long, single strap of prior art disposable restraints.

In addition, the cover 20 completely surrounds the locking boxes 26 and 28 and provides a protective barrier for minimizing tampering. By covering the locking mechanism, the cover 20 makes it difficult to release the lock through insertion of a wire or pin into the locking box 26 and 28 to force each detent 46 and 48 out of engagement with the straps 16 and 18, respectively. Because the interlocking cover 20 surrounds and protects the locking boxes 26 and 28, no unique locking mechanism for minimizing tampering is necessary. Thus, the device does not require straps having specially made locking boxes and existing single loop ties, such as wire ties or the like, can be used in the device.

Figure 3:
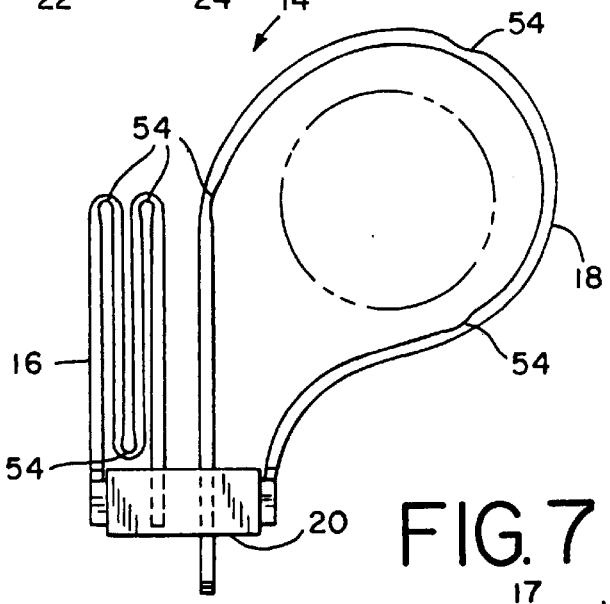
FIG. 3 is a side view showing one loop in the folded storage position and the other loop pulled open for immediate use and showing the notches on the strap for folding the loop.
Figure 8:
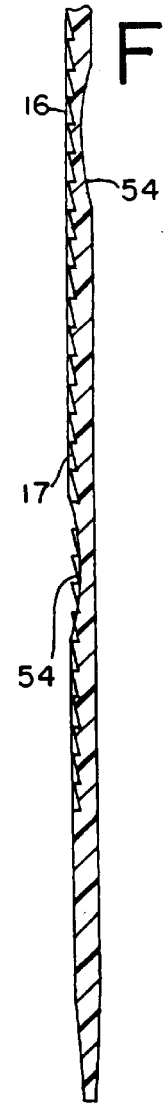
FIG. 8 is a side fragmentary view of a strap showing the notches on the strap for folding the looped strap.

The looped straps of the assembled restraining device may be folded as shown in FIG. 1. In the preferred embodiment, each strap 16 and 18 includes notches 54 for folding the straps into a compact storage position (see FIG. 8). As shown in FIG. 3, the notches 54 are positioned on each strap so that the looped strap may be folded inward toward the cover 20 to form a trifold without disassembling the loops. Thus, the restraining device 14 can be quickly and easily transformed from the compact, folded carrying position to the ready-for-use position by pulling the folded strap outward to fully extend the loop (see FIG. 3).

While the straps 16 and 18 must be severed to removed the restraining device 14 from the detainee once it has been applied, it is an important feature of the subject invention that the cover 20 may be reused to form a new restraining device. Once the straps are cut, the locking boxes 26 and 28 are no longer locked into the cover 20 and the straps may be easily removed and discarded. The restraining device may be reassembled using replacement straps by inserting the locking boxes of the straps into the cover 20 and threading the free tip ends therethrough to form two loops. Thus, the two looped replacement straps are locked into the cover 20 to form the restraining device 14.

Figure 9:
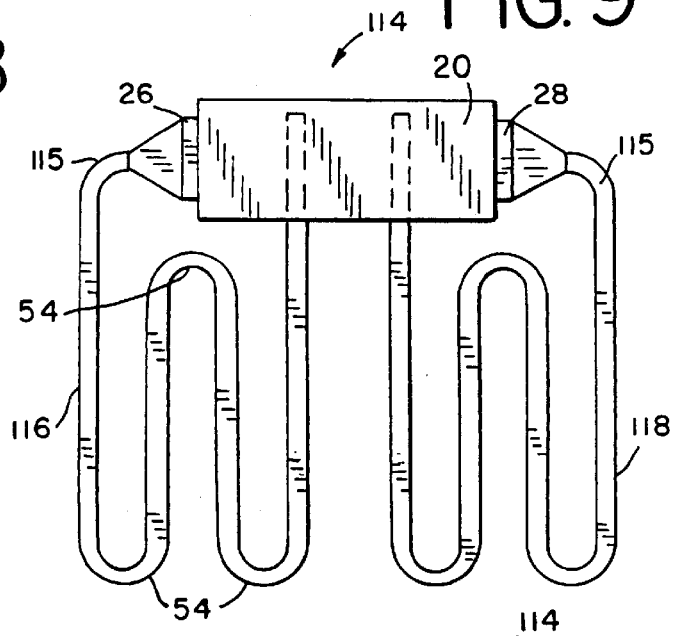
FIG. 9 is a perspective view of an alternative embodiment of the improved disposable restraining device with the straps extending horizontally from the interlocking cover and joined together by an interlocking cover and shown in the folded, storage position.
Figure 10:
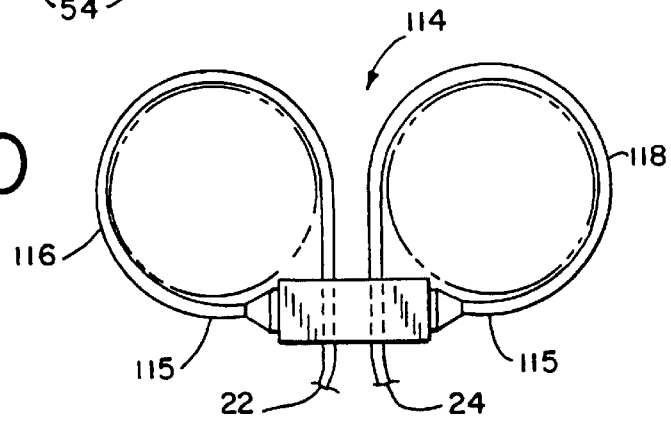
FIG. 10 is a side view of the alternative embodiment of the improved disposable restraining device assembled and ready for use.
Figure 11:
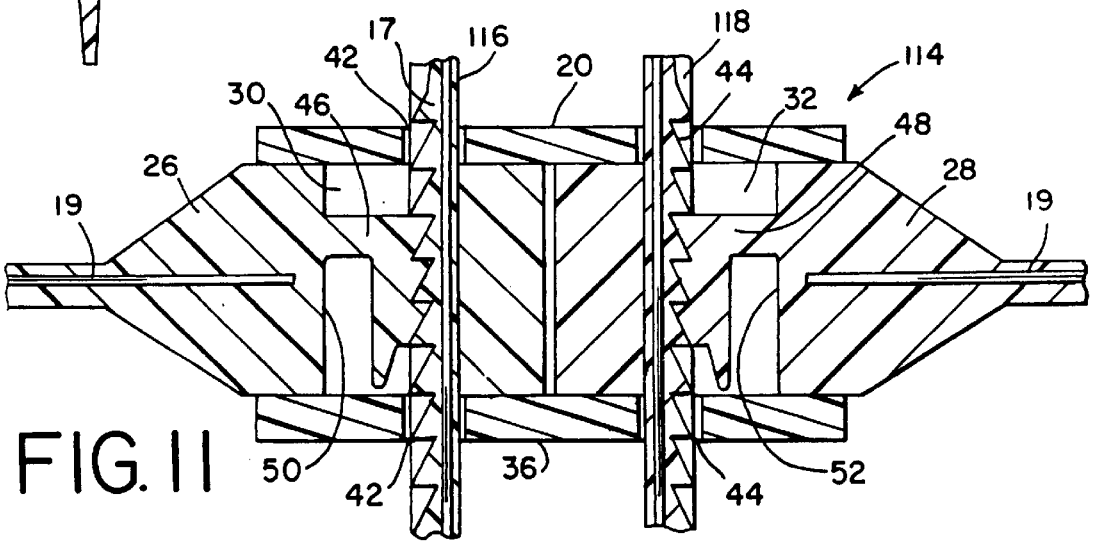
FIG. 11 is an enlarged cross-sectional view of the alternative embodiment showing the ends of the straps inserted into the locking boxes and the saw tooth ribbed surface of the straps engaged by the locking detent for holding the strap in place and illustrating the core material of each strap extending into the locking box.

An alternative embodiment of the subject invention is shown in FIGS. 9–11. In the alternative embodiment, the restraining device 114 includes a first flexible strap 116 and a second, separate flexible strap 118 formed into two loops and joined together by the interlocking cover 20.

As shown in FIG. 9, the straps 116 and 118 are also designed to be folded into a compact storage position. As in the preferred embodiment, the straps 116 and 118 contain a core material, such as metal wire 19, imbedded in the body of each strap 16 and 18 and extending the length of the strap, partially into the locking boxes 26 and 28 (see FIG. 11).

In the alternative embodiment, each locking box 26 and 28 is molded to extend horizontally from its respective strap 116 and 118, so that the straps 116 and 118 extend horizontally at 115 from the cover 20 (see FIGS. 9–11) instead of vertically as shown in FIGS. 1–5 of the preferred embodiment. As shown in FIG. 11, the locking boxes of the straps 116 and 118 of the alternative embodiment include the same locking mechanism as the preferred embodiment for retaining the straps 116 and 118 in loops and locking the looped straps in the cover 20 to form the restraining device 114.

As in the preferred embodiment, the cover 20 of the restraining device 114 provides increased strength to the center area between the two looped straps where stress is the greatest and provides a shield for protecting the locking boxes against tampering. Thus, the alternative embodiment also provides an extremely strong, tamper resistant, improved disposable restraining device which can be easily carried and is instantly ready for use.

Figure 12:
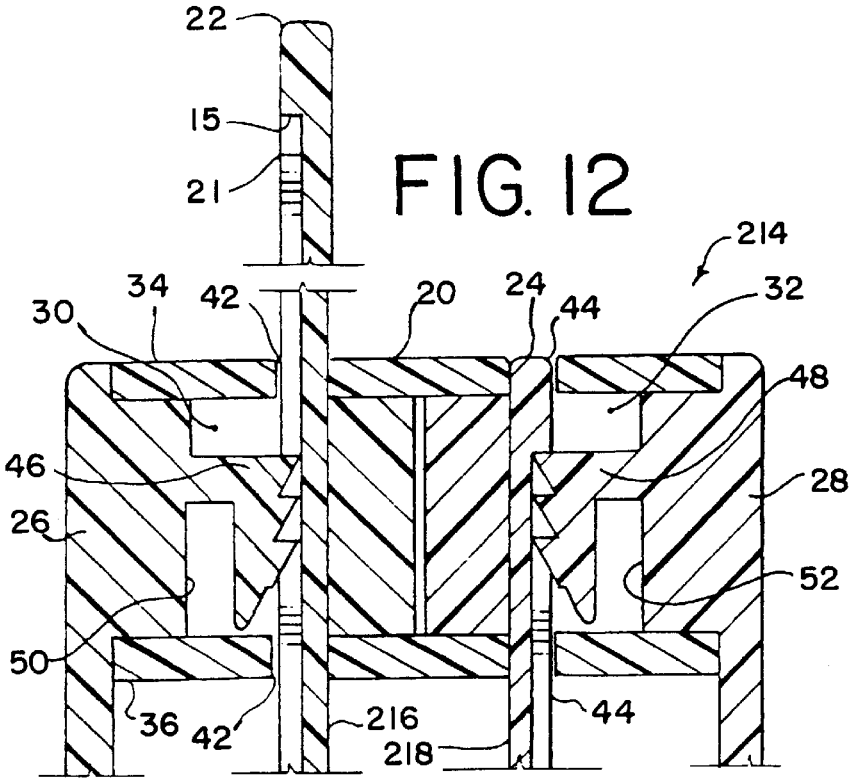
FIG. 12 is an enlarged cross-sectional view of the training embodiment of FIG. 1 showing the ends of the straps inserted into the locking boxes.
Figure 14:
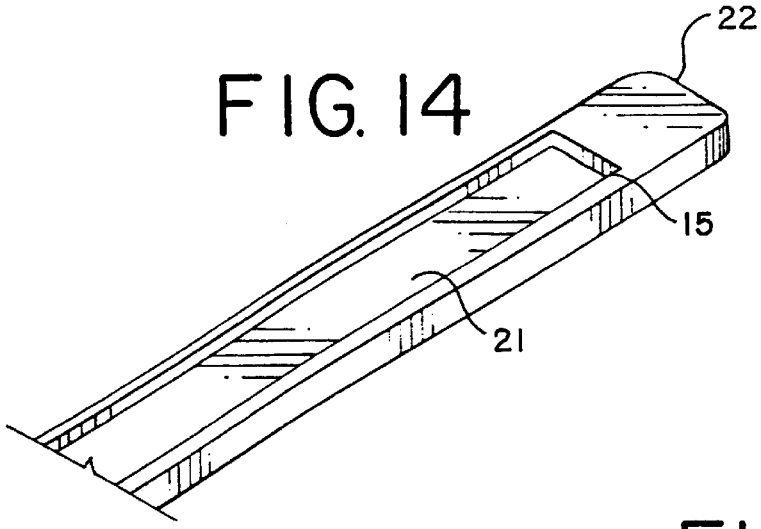
FIG. 14 is a perspective view of the free end of the strap used in the training embodiment.
Figure 13:
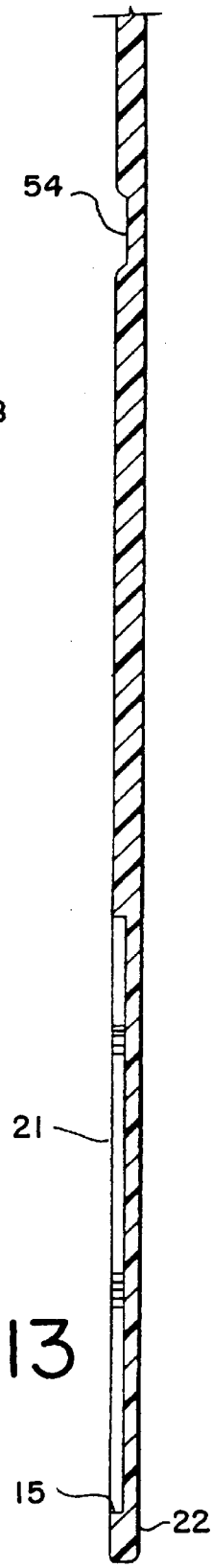
FIG. 13 is a side fragmentary view of the strap used in the training embodiment.

A training embodiment of the restraining device of FIG. 1 is shown in FIGS. 12–14. In this embodiment, the training restraint 214 includes a first flexible strap 216 and a second, separate flexible strap 218 formed into two loops and joined together by the interlocking cover 20. The straps 216 and 218 of the training restraint 214 are designed to be folded into a compact storage position, in the same manner as the straps of the restraining device 14 of FIG 1 are designed to be folded.

In order to allow the restraint 214 to be used for training purposes, each strap 216, 218 is not provided with a saw tooth ribbed surface. Rather, both surfaces of each of the straps 216, 218 are unribbed and preferably smooth. Thus, the free ends of the straps may be grasped and pulled past the detents 46 and 48 for tightening or cinching the loops to restrain the "detainee" in a training exercise. After the training exercise is complete, the straps can be pushed back past the detents 46 and 48 to loosen the loops and allow the "detainee" to be released. Each strap lacks a saw tooth ribbed surface that detents 46 and 48 can resiliently engage to retain the strap once it has been inserted into each central opening 30, 32. Detents 46 and 48 exert a force against the straps, thereby providing resistance to the movement of the straps past the detents. The resistance provided by the detents in the training restraint contributes to the realism of the training exercise.

Because of its design, restraint 214 provides a great advantage for training purposes. Since the restraining device of FIGS. 1–8 could only be used once, a new restraining device would have to be used for each training exercise. This practice leads to much waste and cost. Further, in order to be removed, the restraining device of FIGS. 1–8 had to be cut off. This cutting step would expose trainees to potential injury during removal. Unlike the restraining device of FIGS. 1–8, however, the training embodiment can be used repeatedly in training exercises and can be removed by simply loosening the straps as opposed to cutting them.

As shown in FIGS. 13 and 14, each strap 216, 218 is provided with a locking tooth 15. The locking tooth 15 is engaged by the detents 46, 48 to retain the strap in two loops. It is positioned so that the free tip ends 22, 24 of the straps do not extend beyond the cover 20 in the assembled storage position. The locking tooth 15 prevents each strap 216, 218 from disengaging from the cover 20 and the respective locking box 26, 28.

To save on manufacturing costs, the same locking boxes 26, 28 may be used in the training restraint as are used in the restraining device of FIG. 1. FIG. 11 discloses detents 46 and 48 provided in the training restraint, which exert a force against the straps to provide resistance to the movement of the straps past the detents. The locking boxes and the straps of the training restraint may be molded from production strap resin while the cover 20 may be constructed of a harder, less flexible material. Also, the same production strap resin may be used for the straps in both the standard and training restraints providing increased manufacturing efficiencies.

From the exterior, the training restraint of FIGS. 12–14 resembles the restraining device of FIGS. 1–8. To distinguish it from the non-training restraint, the training restraint is provided with means for identifying it as the training embodiment. As mentioned above, the training restraint of FIGS. 12–14 is provided with straps 216 and 218 that both lack a saw tooth ribbed surface. Instead both surfaces of each of the straps 216, 218 are unribbed and preferably smooth. Thus, the straps having unribbed or smooth surfaces function as a means to identify the restraint as a training embodiment.

The training restraint may be provided with a further means for identifying the restraint as a training embodiment. In the preferred embodiment, providing the cover of the training restraint in a certain color comprises a further means for identifying the restraint as a training embodiment. For example, if the cover of the restraining device of FIGS. 1–8 is black, the cover of the training restraint of FIGS. 12–14 may be provided in the color red. Such an identifying means is import to law enforcement personnel who must distinguish a training restraint from a non-training embodiment in times of need. With such identifying means, law enforcement personnel can quickly distinguish between the two embodiments and select the appropriate embodiment for each situation. Being able to visually identify the training embodiment is particularly important, in view of the fact that training restraints can be made by removing the internal detents, thereby rendering it impossible to visually identify standard restraints from training restraints.

Figure 15:
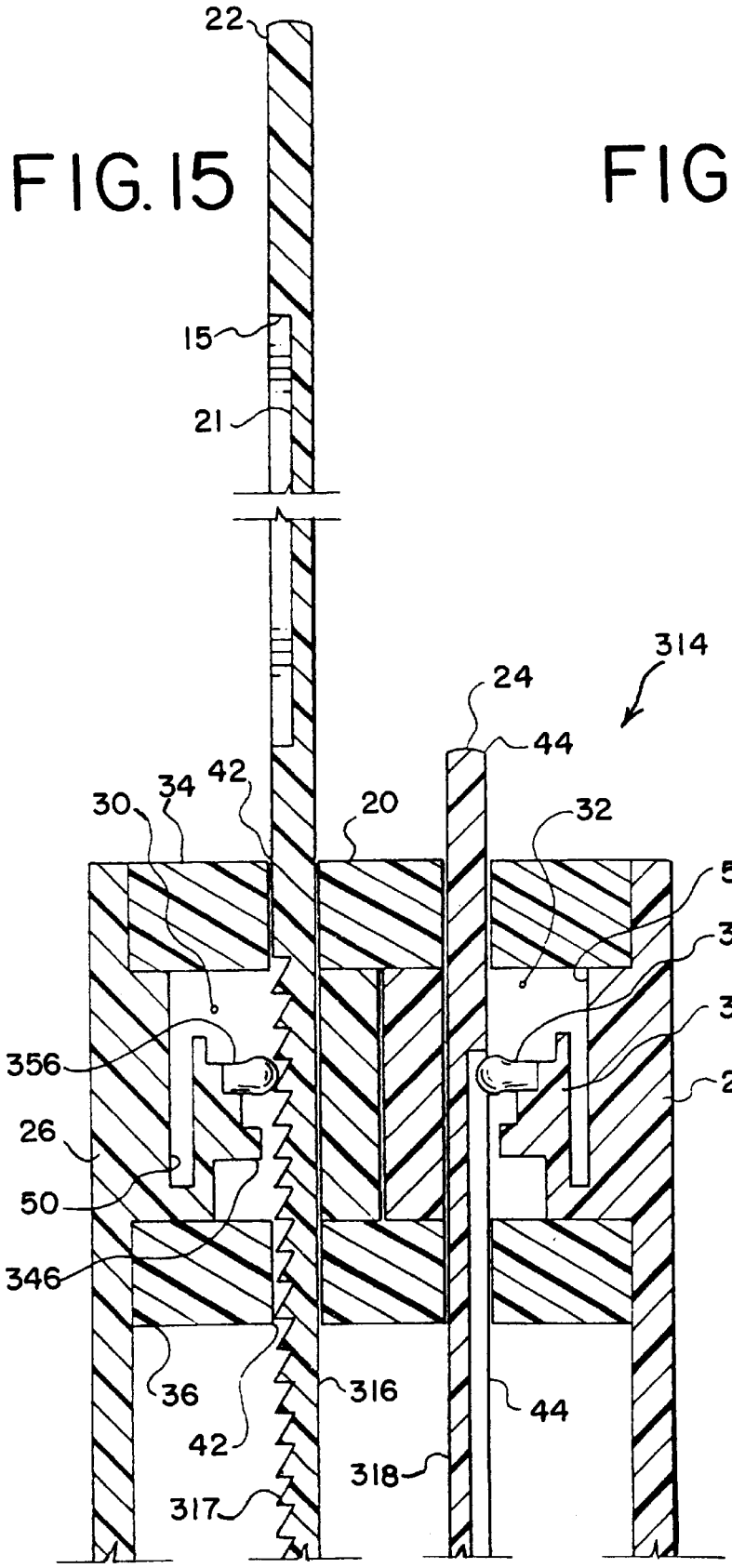
FIG. 15 is an enlarged cross-sectional view of an alternate embodiment of the training restraint.
Figure 16:
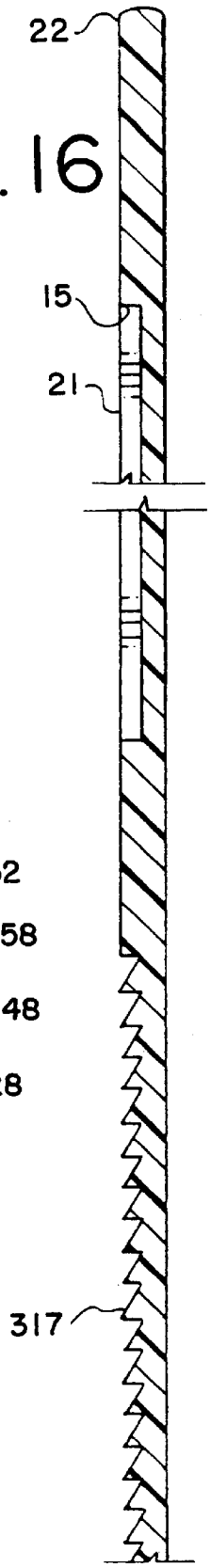
FIG. 16 is a side fragmentary view of the strap used in the training restraint of FIG. 15.

An alternate embodiment of the training restraint is shown in FIGS. 15–16. As can be seen from FIGS. 15–16, the training restraint 314 is similar to training restraint 214, but differs from it in two aspects. One difference involves the details of the straps employed and the other difference deals with the detents used in the locking boxes.

The training restraint 314 includes a first flexible strap 316 and a second, separate flexible strap 318 formed into two loops and joined together by the interlocking cover 20. The straps 316 and 318 of the training restraint 314 are designed to be folded into a compact storage position, in the same manner as the straps of the restraining device 14 of FIG. 1 are designed to be folded. Unlike the straps used in the training embodiment of FIGS. 12–14, the surface of each strap 316, 318 is provided with a plurality of saw tooth ribs 317.

In order to allow the restraint 314 to be used for training purposes, each locking box 26, 28 is provided with a respective detent 346, 348. Detents 346, 348 differ from detents 46, 48 in that each detent is provided with an oversized tooth 356, 358 that prevents the detents 346, 348 from lockingly engaging the saw tooth ribbed surface 317 of each strap 316 and 318. Due to the presence of the oversized teeth 356, 358, the ribbed surfaces 317 can be moved past the detents 346, 348 in either direction.

To use the training restraint 314 to restrain a "detainee" in a training exercise, the free ends of the straps may be grasped and pulled past the detents 346 and 348 for tightening or cinching the loops about the detainee's wrists. After the training exercise is complete, the detainee can rapidly release the restraint by rolling the wrists outward. The presence of the oversized teeth enables the straps to be loosened by allowing the straps to be moved past the detents 346, 348.

Although detents 346 and 348 do not lockingly engage the saw tooth ribbed surface 317 of straps 316, 318, they do exert a certain amount of force against the straps, thereby providing resistance to the movement of the straps past the detents. The resistance provided by the detents in the training restraint contributes to the realism of the training exercise. To distinguish it from the non-training restraint, the training restraint 314 is provided with means for identifying it as the training embodiment. In the preferred embodiment, providing the entire training restraint in a certain color comprises a means for identifying the restraint as a training embodiment. For example, if the restraining device of FIGS. 1–8 is yellow, the training restraint of FIGS. 15–16 may be provided in the color red. Alternately, only a portion of the training restraint, such as the locking block, may be provided in the color red. With such identifying means, law enforcement personnel can quickly distinguish between the training restraint and a non-training embodiment and select the appropriate embodiment for each situation.

While specific embodiments and features of the invention have been disclosed herein, it will be readily understood that the invention encompasses all enhancements and modifications within the scope and spirit of the following claims.

What is claimed is:

1. A restraining device for training comprising:

a. a first flexible strap and a second, separate flexible strap, each strap having a first side and a second side and opposite outer ends and including a free tip end at one outer end;

b. a ribbed surface disposed along one side of each strap;

c. a locking box at the other outer end of each strap, the locking box having a central opening extending therethrough, the central opening adapted for receiving a tip end;

d. each locking box further comprising a detent, each detent being provided with a tooth for engaging the ribbed surface of the respective strap, each tooth permitting the respective strap to move past the detent in either direction to allow the device to be re-used; and e. a cover for joining the straps together, the cover adapted to be positioned about the locking boxes of the straps, the cover including slots for receiving the tip ends of the straps;

whereby each strap forms a loop when its tip end is threaded through the slots of the cover and the central opening of the locking box.

2. The restraining device of claim 1 further comprising means for identifying the device for training purposes.

3. The restraining device of claim 2 wherein the identifying means comprises providing a portion of the device in a certain color.

4. The restraining device of claim 2 wherein the identifying means comprises providing the entire device in a certain color.

5. The restraining device of claim 1 wherein each strap further comprises at least one notch located between the tip end and the locking box, whereby the strap may be folded at the notch for folding each loop of the device and unfolded by pulling out the center of each loop, wherein the device is instantly ready for use.

6. The restraining device of claim 5 wherein each strap includes three notches.

7. The restraining device of claim 1 wherein the cover is constructed of a harder material than the straps.

8. The restraining device of claim 1 wherein the straps are constructed of a resin material.

9. The restraining device of claim 1 wherein each strap further includes a locking tooth positioned on one side of the strap near its free tip end, wherein the free tip end is inserted into the central opening of the locking box to form a closed loop and the detent engages the locking tooth for preventing the strap from being withdrawn from the opening and retaining the strap in the closed looped position.

10. The restraining device of claim 1 wherein each detent exerts a force against the respective strap to provide resistance to the movement of the strap past the detent.

* * * * *